US006659022B1

(12) United States Patent
Holtz

(10) Patent No.: US 6,659,022 B1
(45) Date of Patent: Dec. 9, 2003

(54) LAPTOP COMPUTER TABLE

(76) Inventor: Gilbert J. Holtz, 182 Tibbetts Rd., Yonkers, NY (US) 10705

( * ) Notice: Subject to any disclaimer, the term of this patent is extended or adjusted under 35 U.S.C. 154(b) by 0 days.

(21) Appl. No.: 10/144,309

(22) Filed: May 13, 2002

(51) Int. Cl.[7] ..... A47B 13/00

(52) U.S. Cl. ..... 108/158.12; 108/50.01; 108/43

(58) Field of Search ..... 108/153.1, 156, 108/157.1, 157.14, 157.15, 157.16, 157.18, 158.12, 180, 186, 50.01, 43

(56) References Cited

U.S. PATENT DOCUMENTS 740,846 A * 10/1903 Giddings ..... 108/158.12
1,393,679 A * 10/1921 Forster ..... 403/172
3,069,216 A * 12/1962 Vaeth ..... 312/195
4,740,032 A * 4/1988 Olsen et al. ..... 297/139
4,765,253 A * 8/1988 Schappach ..... 108/158.12
4,976,204 A * 12/1990 Konkle ..... 108/43

* cited by examiner

*Primary Examiner*—Jose V. Chen
(74) *Attorney, Agent, or Firm*—Myron Amer PC

(57) ABSTRACT

To obviate the discomfort in the use of a so-called laptop computer which because a lightweight object, i.e., typically 10 pounds, is positioned on the lap of the user, there is provided as an alternative a readily assembled table, the stability of which is supplemented by the computer-user while in a seated position at the table closing his/her knees against support legs of the table.

1 Claim, 2 Drawing Sheets

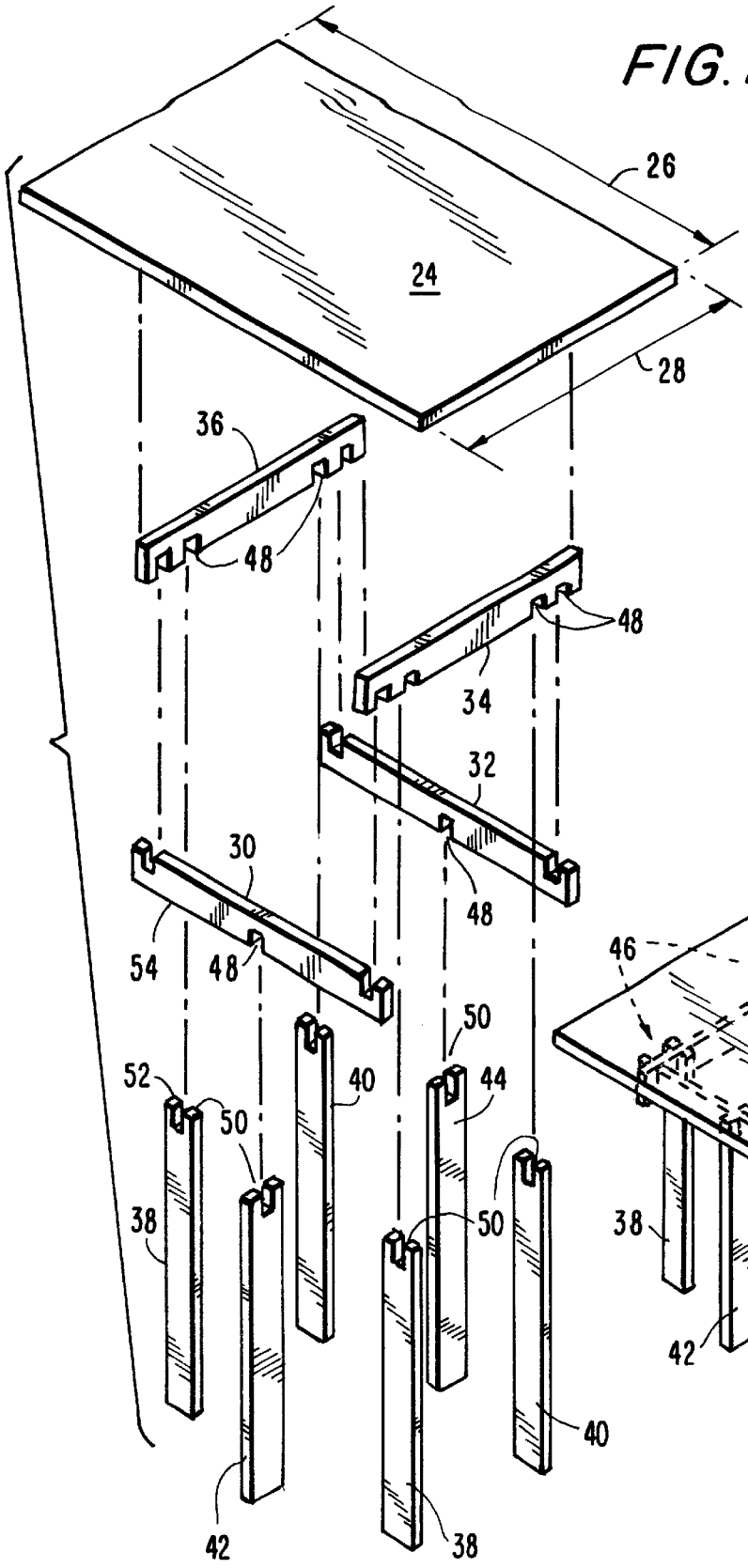
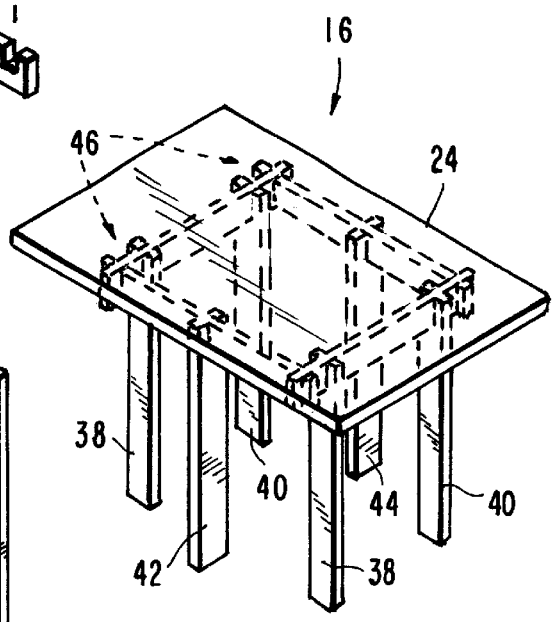
FIG. 2

FIG. 3
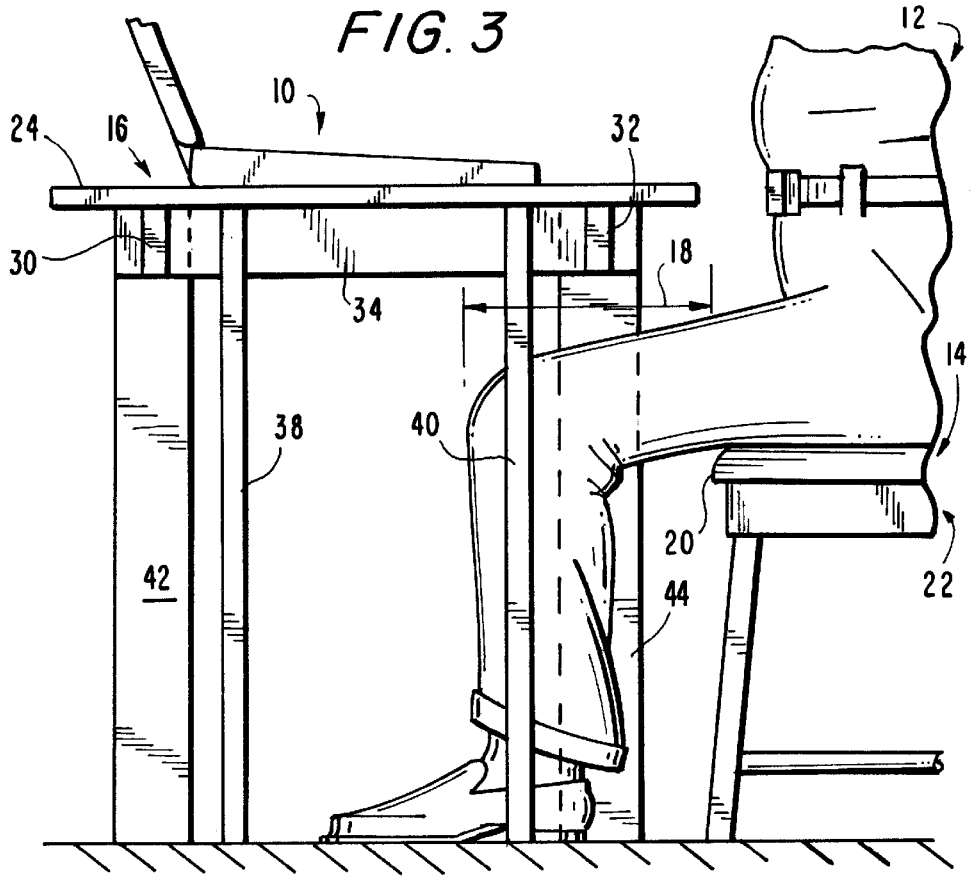
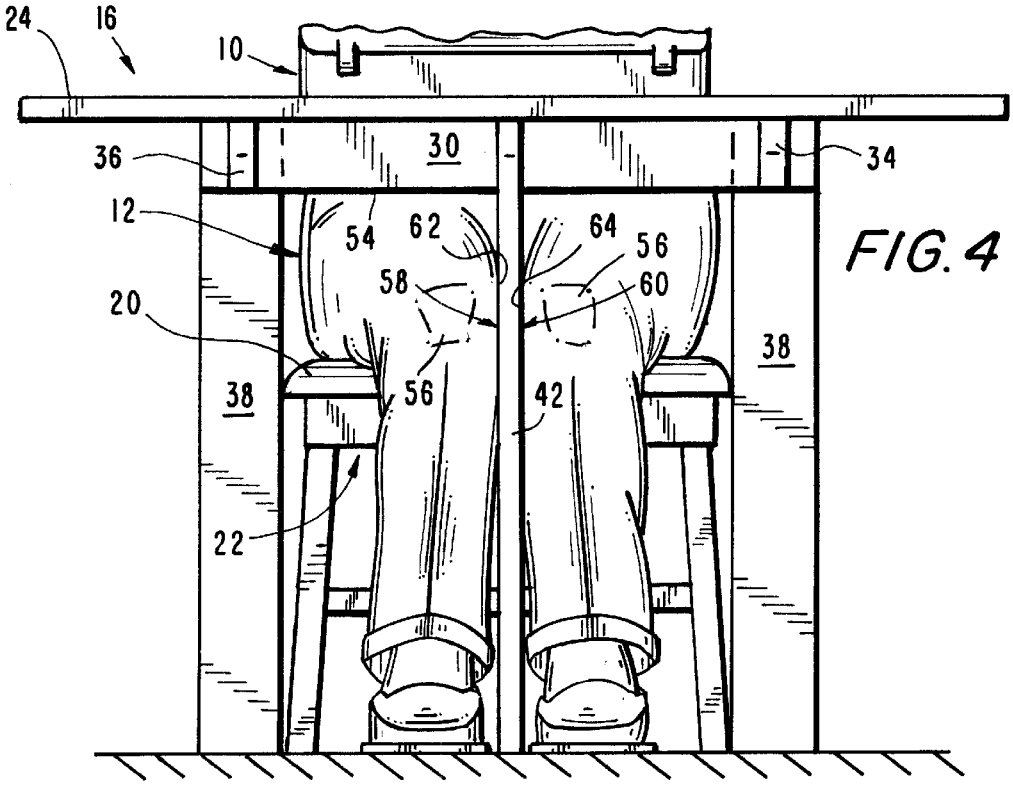
FIG. 4

LAPTOP COMPUTER TABLE

The present invention relates generally to improved added convenience in the use of a laptop computer, the improvement more particularly being using to advantage the lap position of the computer during its use to obtain the derived benefit.

EXAMPLE OF THE PRIOR ART

It is well known to use components of furniture that readily assemble into three-dimensional structures to achieve a compact condition during storage and what is required of the furniture during its intended end use. Examples of such furniture are desks and tables, and exemplary of their popular use is U.S. Pat. No. 3,069,216 for "ARTICLES OF FURNITURE issued to Vaeth on Jun. 8, 1961. Underlying the present invention is the recognition of a synergism between such furniture and the operation of a laptop computer, wherein the latter enables more effective use of the former, and which consequently obviates discomfort which heretofore has been tolerated in the operation and use of laptop computers.

Broadly, it is an object of the present invention to overcome the foregoing computer operation discomfort and other shortcomings of the prior art.

More particularly, it is an object to use a table support for the weight of the computer and to stabilize the table in this end use using to advantage the laptop operative position of the computer, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is an exploded perspective view of a laptop computer table in accordance with the present invention;

FIG. 2 is another perspective view, illustrating the table in assembled condition;

FIG. 3 is a partial side elevational view of the table in use; and

FIG. 4 is a front elevational view thereof.

On numerous occasions at which only seating facilities are available for computer use, such as for a vehicle passenger, for a category of a computer 10, and as the popular name implies, the computer 10 is positioned and operated on the lap of the user. Over time, however, the bottom edges as well as the approximate ten pound weight of the laptop computer 10 can, and often does, become a source of discomfort.

The present invention provides a user 12 who can assume a sitting position, as noted at 14, the option of having available a readily assembled table, generally designated 16, to support the laptop computer 10 in convenient reach on the overhang 18 or extension of his/her thighs or lap beyond the edge of the seat 20 of the chair 22 in use.

Table 16 includes a top 24 in length 26 and width 28 dimensions delimiting a comparable work area of an average slightly oversize of the noted overhang 18, in this case being twelve inches by fourteen inches, and said table in use is horizontally oriented, to serve its intended computer 10 supporting function. To this end, plural interconnected peripheral spaced apart front and ear support panels 30, 32 and side support panels 34, 36 are, in assembled condition, disposed in depending relation to the table top 24.

At least two, but in this illustrated embodiment, four leg panels, each of a length of twenty-eight inches and width of three inches, are the vertical support for the table support panels in their assembled rectangular configuration, the pair of fore leg panels 38 and aft leg panels 40 being transversely oriented and the leg panels 42 and 44 respectively in fore and aft locations with respect to the table top 24 and, to be noted, the foregoing are in selected attachment to the table support panels 30, 32, 34 and 36. The selected attachment, to permit ready assembly of the table 16, being cooperating pairs, individually and collectively designated 46, of downwardly 48 and upwardly 50 facing interconnecting notches on upper end edges 52 of the transverse and fore and aft leg panels 38, 40 and 42 and 44, and on lower end edges 54 of the front and rear support panels 30, 32 and the side support panels 34, 36.

Thusly assembled, the interconnected notches 46 result in a reasonably stable table structure. In practice however, the stability is supplemented by the user 12 in his/her sitting position, wherein knees of the sitter 12 at the table 16 initially will be understood to be in straddling clearance positions on opposite sides of a vertical plane of the fore 42 or aft 44 leg panels and the user 12 instructed to urge his/her knees 56 from their clearance positions in opposite closing movements 58 and 60 into contact against opposite sides, as noted at 62 and 64, against the fore or aft leg panels 42 and 44, which obviates wobble and otherwise contributes to the stability of the table 16 during use.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A readily assembled laptop computer table comprising:

A. a flat horizontally oriented table top;

B. plural interconnected peripheral spaced apart opposite and front and rear table sides oriented in depending relation to said table top;

C. at least two spaced apart transversely oriented leg panels each first panel having first and second sides which define first vertical planes, each said first vertical plane being substantially parallel to each other in a selected attachment to cooperating said opposite spaced apart table sides;

D. at least two spaced apart fore and aft oriented leg panels each second panel having first and second sides which define second vertical planes, each second vertical plane being substantially perpendicular to each said first vertical plane in similar selected attachment to cooperating said front and rear table sides;

E. said selected attachment being cooperating pairs of downwardly and upwardly facing interconnected notches on upper ends of said transverse and fore and aft leg panels and on lower ends of said opposite sides and fore and aft table sides; and F. knees of a sitting user of a laptop computer at said table initially in straddling clearance positions on opposite sides of a vertical plane of said fore and aft leg panels and subsequently urged in closing movement therefrom into contact against opposite sides of said fore and aft leg panels;

whereby said leg panel-contacting knees contribute to the stability of said assembled table.

* * * * *